US009095950B2

(12) United States Patent
Kuether et al.

(10) Patent No.: US 9,095,950 B2
(45) Date of Patent: Aug. 4, 2015

(54) MOTOR-DRIVEN ANGLE GRINDER

(75) Inventors: Ludwig Kuether, Waldenbuch (DE); Fabian Huber, Villingen-Schwenningen (DE)

(73) Assignee: METABOWERKE GMBH, Nuertingen (DE)

( * ) Notice: Subject to any disclaimer, the term of this patent is extended or adjusted under 35 U.S.C. 154(b) by 407 days.

(21) Appl. No.: 13/509,647

(22) PCT Filed: Oct. 15, 2010

(86) PCT No.: PCT/EP2010/065505

§ 371 (c)(1),
(2), (4) Date: Jun. 14, 2012

(87) PCT Pub. No.: WO2011/061022

PCT Pub. Date: May 26, 2011

(65) Prior Publication Data

US 2012/0282846 A1 Nov. 8, 2012

(30) Foreign Application Priority Data

Nov. 17, 2009 (DE) ..... 10 2009 053 614

(51) Int. Cl.

| | |
|---|---|
| ***B24B 23/02*** | (2006.01) |
| ***B24B 47/12*** | (2006.01) |
| ***B25F 5/00*** | (2006.01) |
| ***B25F 5/02*** | (2006.01) |
| *B24B 7/18* | (2006.01) |

(52) U.S. Cl.

CPC ..... *B24B 23/028* (2013.01); *B24B 47/12* (2013.01); *B25F 5/001* (2013.01); *B25F 5/02* (2013.01); *B24B 7/186* (2013.01)

(58) Field of Classification Search

CPC ..... B24B 23/028; B24B 47/12; B24B 7/186; B23D 47/126; B23Q 5/045; B25F 5/001

USPC ..... 451/354, 355, 356, 357, 358, 359, 344, 451/363, 452

See application file for complete search history.

(56) References Cited

U.S. PATENT DOCUMENTS

| | | | | |
|---|---|---|---|---|
| 2,267,781 | A * | 12/1941 | Albertson | 451/359 |
| 6,386,961 | B1 | 5/2002 | Cureton | |
| 6,871,711 | B2 * | 3/2005 | Hansson | 173/216 |
| 7,988,538 | B2 * | 8/2011 | Trautner et al. | 451/344 |
| 2007/0295521 | A1 * | 12/2007 | Wiker et al. | 173/162.1 |

FOREIGN PATENT DOCUMENTS

| | | | |
|---|---|---|---|
| DE | 10 2008 059 247 | A1 | 5/2010 |
| EP | 1 938 924 | A1 | 2/2008 |

* cited by examiner

*Primary Examiner* — Timothy V Eley
(74) *Attorney, Agent, or Firm* — Paine Hamblen, LLP

(57) ABSTRACT

A motor driven angle grinder is described and which includes an electric motor; a transmission coupled to the electric motor and which includes a motor shaft and a tool spindle; a crown wheel in the form of a hat is provided and which forms a recess that receives the tool spindle and a bearing, and wherein the crown wheel defines toothing which surrounds the recess, and wherein the transmission housing and the angle grinder have low relative height profiles which permits the angle grinder to be used in restricted or tight space working environments.

8 Claims, 4 Drawing Sheets

MOTOR-DRIVEN ANGLE GRINDER

RELATED PATENT DATA

The present patent application claims priority from German Patent Application Ser. No. 10 2009 053 614.0, and which was filed on Nov. 17, 2009 and PCT Application Ser. No. PCT/EP2010/065505, and which was filed on Oct. 15, 2010.

The present invention relates to a motor-driven angle grinder, and in particular to a motor-driven angle grinder driven by an electric motor, which has a motor housing accommodating a multiplicity of motor components and a transmission housing accommodating a multiplicity of transmission components, and wherein the invention further has a motor shaft and a tool spindle which are oriented at an angle to one another via an angular gear arrangement having a crown wheel, and wherein a grinding or separating tool which can be driven in rotation is mountable on the tool spindle.

A number of angle grinders have been disclosed, heretofore. An example of such art includes EP 1 938 924 A1. The teachings of this patent is incorporated by reference herein.

It is the object of the present invention to provide an improved angle grinder of the above-mentioned type such that poorly accessible work regions or areas which are bordered, in particular, by sections which are oriented at an acute angle to one another can be machined in an improved manner or can be machined if at all in the first place.

In the case of an angle grinder of the above-mentioned type, this objective is achieved according to the invention in that the crown wheel is formed in the shape of a hat, and is further arranged such that a recess forming the hat shape is oriented toward that side of the crown wheel that faces the tool, and a toothing on the crown wheel is arranged and located radially outside an elevation, which borders the recess, of the crown wheel, and on that side of the crown wheel that is remote from the tool. The recess is dimensioned such that the tool spindle and a bearing device mounting the tool spindle with respect to a flange of the transmission housing extend in the axial direction and into the recess.

On account of this configuration and according to the teachings of the present invention, a flat construction, which has not hitherto been realized in the case of angle grinders, is achieved in the region of the transmission housing. As a result, the range of application and usefulness of the angle grinder is widened considerably even under spatially restricted working conditions. As a result of the claimed configuration and spacial orientation of the crown wheel, the bearing device for supporting the tool spindle, and which is typically a roller-type bearing device, is arranged at the level of the crown wheel and located within the transmission housing. This feature saves considerable axial installation space. Further, in the disclosed invention an elevation bordering the recess toward the other side is provided on the crown wheel. On account of the fact that the toothing as provided on the crown wheel is arranged radially outside this elevation, a drive component meshing with the crown wheel, for example a pinion driven by the motor shaft or fitted on the motor shaft, can also be arranged at least partially within the axial installation space of the crown wheel. As a result of this arrangement, optimal use is made of the available axial installation space, and a minimum height of the transmission housing in the region of the tool spindle can be realized.

In another aspect of the present invention, it is proposed that a concentric portion of the flange of the transmission housing also extends in the axial direction and into the recess in the crown wheel. In this way, the portion of the flange extending into the recess can form an accommodating region for the bearing device.

In further continuation of this concept of the invention, the bearing device as earlier described, is secured axially against falling out with respect to the flange of the transmission housing, and in particular with respect to the concentric portion of the flange of the transmission housing, by an axially acting securing element, such as a snap ring, and wherein the axial securing element is fitted in a position which is located behind the flange.

In a preferred embodiment of the disclosed angle grinder, and according to the teachings of the present invention, a height of the transmission housing in the region of the grinding or separating tool lies in a range of about 32 mm. to about 40 mm. The height is measured in the axial direction of the tool spindle from an outer side, that faces the tool, as far as a top side, that is remote from the tool, of the transmission housing. It proves to be advantageous in this invention for the transmission housing to have this maximum height over the entire extent of the grinding or separating tool. However, the transmission housing should at least have this maximum height as far as the location of the longitudinal axis of the tool spindle.

Since angle grinders having such a low height of the transmission housing in the region of the tool spindle have not hitherto been available, protection is of course claimed for this concept of the invention. In particular, protection is claimed for this concept of the invention in conjunction with the teaching that the crown wheel is formed in the shape of a hat and is further arranged such that a recess forming the hat shape is oriented toward that side of the crown wheel that faces the tool.

According to a further embodiment of the present invention, the transmission housing is beveled toward the front, and preferably toward the sides and particularly on that side of a longitudinal axis of the tool spindle that is remote from the motor housing, such that the extended course of the bevel does not project beyond a peripheral edge of the tool. In prior art angle grinders, the extended course of the bevel intersects the plane of the tool and is located outside, and in front of the peripheral edge of the tool. This arrangement severely restricts the usability of the machine tool at poorly accessible work regions, as is shown in FIG. 1. Further patent protection is claimed for this feature of the invention, too.

In a further development of this concept of the invention, another embodiment of the invention is proposed, and wherein a tangent to the transmission housing forms an angle with the plane of the tool at the peripheral edge of the tool and which lies in a range of about 35° to about 42° . Further, single handed protection is a claimed feature of the present invention.

It has also proven to be advantageous for the tool spindle to be produced as a separate component from the crown wheel, and for the tool spindle to extend through the crown wheel, and for a second bearing device for the tool spindle to be provided on that side of the crown wheel that is remote from the tool.

According to a further embodiment of the angle grinder according to the present invention, it is proposed that the transmission housing be formed in an elongate manner such that a dimension of the transmission housing starting from a longitudinal axis of the tool spindle, and extending in the direction of the motor housing is greater than the radius of the tool, so that the tool does not engage beneath the motor housing. This elongated configuration of the transmission housing, which lengthens a typical long handle shape of the motor housing, makes it possible, for the first time, to arrange the tool with respect to the components of the transmission housing and of the motor housing, such that it does not engage beneath the motor housing. However, this design feature opens up the possibility of arranging or fabricating the tool in an orientation which is closer to the transmission housing in the direction of the longitudinal axis of the tool spindle, thereby again saving overall axial height of the transmission housing region. Patent protection is claimed for this concept of the invention, and in particular in conjunction with the feature whereby the crown wheel is formed in the shape of a hat, and is further arranged such that a recess forming the hat shape is oriented toward that side of the crown wheel that faces the tool.

In a further development of this concept of the invention, it is proposed in one form of the invention for the tool to be arranged on the transmission housing in such a manner that the upper and/or lower tool plane of the tool, when the machine tool is viewed from the side, and perpendicularly relative to the tool spindle, does not come to rest beneath the motor housing.

It also proves to be advantageous for the motor-driven angle grinder, and in particular the transmission housing associated with same, and the components thereof, to be configured such that a protective hood for the tool does not engage beneath the motor housing but, when the motor-driven angle grinder is viewed from the side, and perpendicularly to the tool spindle, is arranged next to the end of the motor housing, i.e. entirely within the region of the transmission housing. More specifically, and on account of the low flat construction according to the invention and which relates to the transmission housing, it is possible to arrange the protective hood, and a holder for the protective hood, entirely beneath that side of the flange of the transmission housing that faces the tool, so that it axially overlaps the installation space of the motor housing but,—as mentioned earlier—is arranged in front of the motor housing. Also as a result of the present teaching, a flat construction, which has never been realized before, of an angle grinder, as a whole, can be realized, and more specifically measured from a lower tool plane, to an upper side, that is remote from the tool, of the transmission housing.

Further features, details and advantages of the present invention can be understood from the appended patent claims, and from the illustrations and the following description of a preferred embodiment of the invention. In the drawings:

Figure 1:
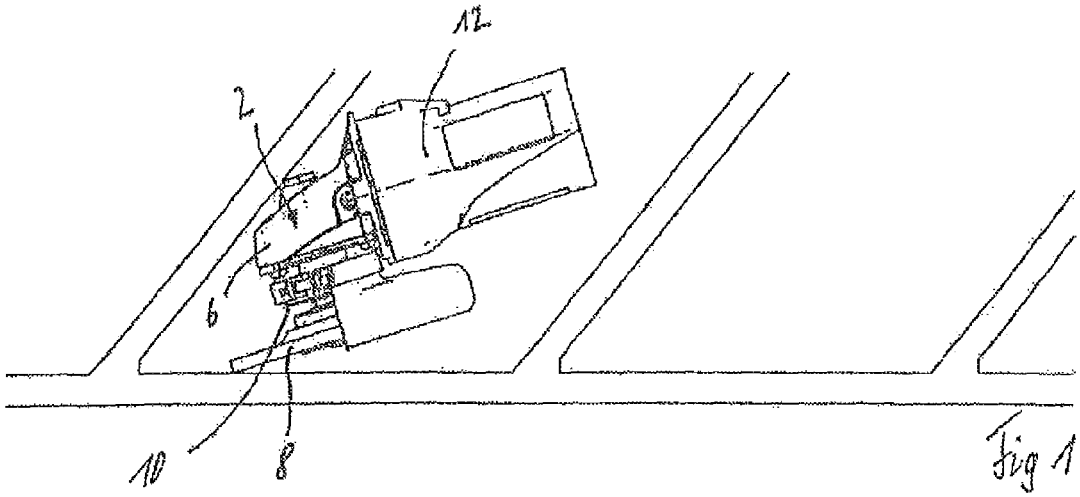
FIG. 1 illustrates the restricted usability of a prior art, known angle grinder.
Figure 2:
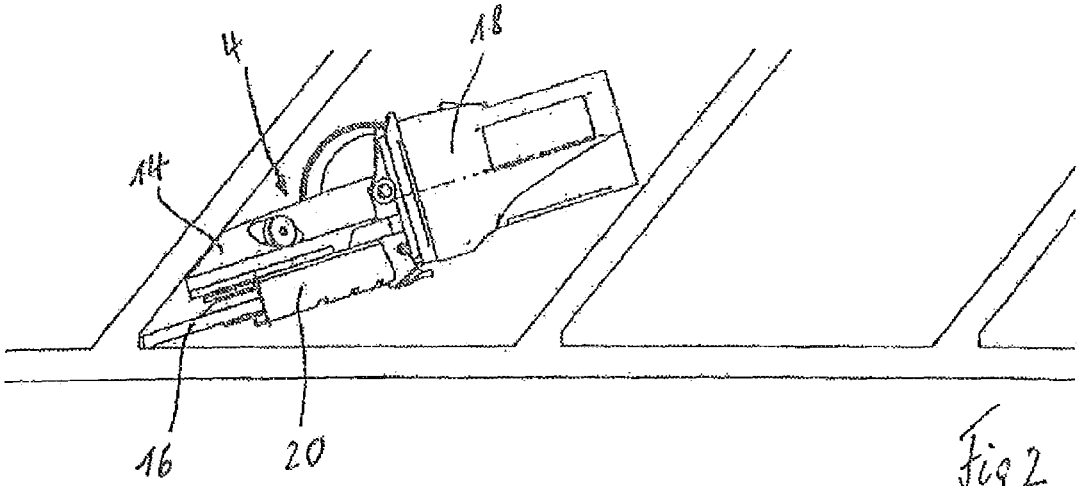
FIG. 2 illustrates the improved usability of an angle grinder according to the teachings of the present invention and which has a flat construction.

FIGS. 1 and 2 show the usefulness or usability of a known prior art angle grinder 2 and an angle grinder 4 according to the teachings of the present invention and having a flat construction as will be described, hereinafter. In the case of the prior art angle grinder 2, it will be readily noticed that a transmission housing 6 is very tall, overall, and the tool plane of the grinding or separating tool 8 is at a relatively great distance from that side 10 of the transmission housing 6 that faces the tool. The tool 8 rotatably engages beneath a motor housing 12, and which adjoins the transmission housing 6. On account of the large overall axial height (FIG. 1), the usability of the known angle grinder 2 is restricted in poorly accessible regions, which are illustrated in FIG. 1 here by way of pipe sections that are oriented at an acute angle to one another. By contrast, the angle grinder 4 which is built according to the teachings of the present invention and as seen in FIG. 2 is very flat, in its profile, overall. More specifically, the height of the transmission housing 14 is reduced as compared with known prior art embodiments. Further, the grinding or separating tool 16 is located entirely beneath the transmission housing 14; and it does not engage beneath the motor housing 18 as is the case in known embodiments. Even a protective hood 20 is provided beneath the transmission housing 14, and thus, likewise does not engage beneath the motor housing. As a result of this design the overall flat construction can be reduced even further. It can be seen from FIG. 2 that the usability of the angle grinder 4 according to the teaching of the present invention in regions of limited accessibility is considerably improved. As will be readily seen by reference to FIG. 2, the transition region of the illustrated pipes or work region can be reached and machined without problems, even when the transition or work region is bordered by an acute angle of only 35° between the components.

Figure 3:
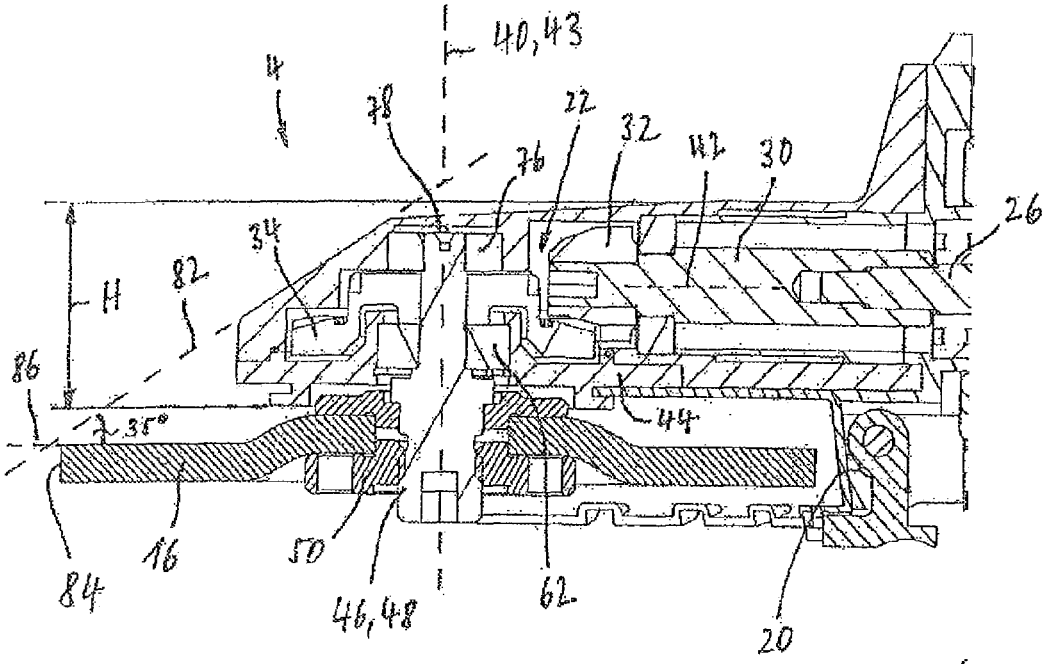
FIG. 3 shows a transverse, vertical sectional view of an angle grinder according to the teachings of the present invention and which is shown in the region of the transmission housing.
Figure 4:
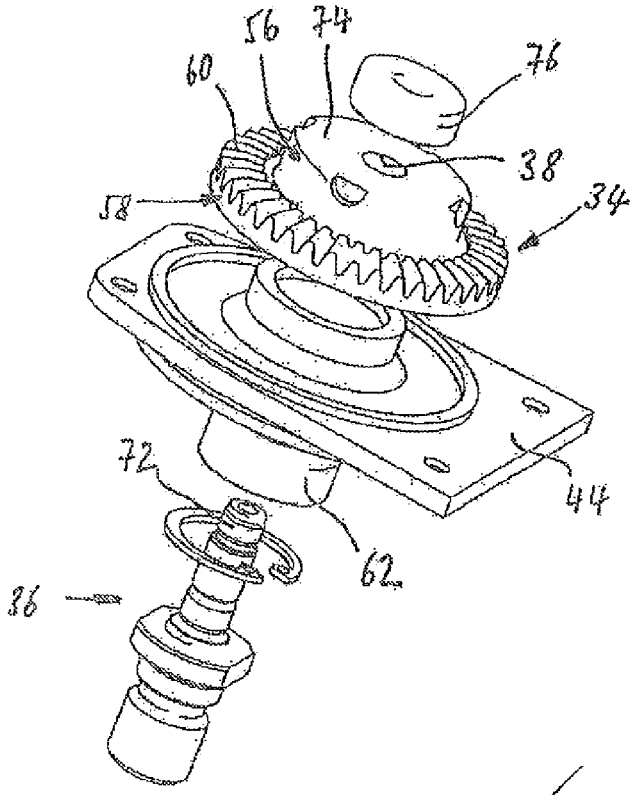
FIG. 4 and FIG. 5 show an exploded perspective, side elevation view of a number of components of the angle grinder and which is taken in the region of the tool spindle.
Figure 5:
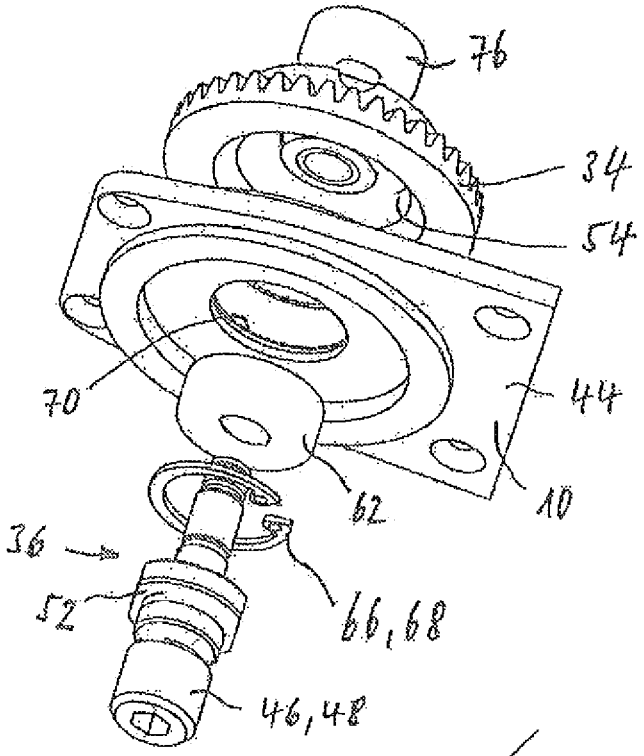

FIGS. 3-5 show the configuration of the drive train of the new angle grinder 4 according to the invention, and which include an angular gear arrangement 22. Illustrated in FIG. 3 is a motor shaft 26, which is drive-connected, as appropriate, via a transmission arrangement, which is not illustrated in detail, to a pinion shaft 30 which is aligned with the motor shaft 26. At its front, free end, the pinion shaft 30 carries a pinion wheel 32, which meshes with a crown wheel 34, and thus forms the angular gear arrangement 22. A tool spindle 36 (FIG. 5) is formed as a component separate from the crown wheel 34, and extends through the crown wheel 34, and through a central shaft opening 38 (FIG. 4). A longitudinal axis (FIG. 3) 40 of the tool spindle 36 extends in this case at right angles to a longitudinal axis 42 of the pinion shaft 30 and defines an axial direction 43 of the tool spindle.

The tool spindle 36 further passes through a flange 44 which forms a portion of the transmission housing 14, and in a manner which will be described in more detail, hereinafter. The flange 44 is configured in the form of a plate, and the transmission housing 14 terminates towards the outside, and in the direction of the tool side. At a free end section 46, the tool spindle 36 carries, for example, an external thread 48, onto which there can be screwed a clamping means 50 which tightens the tool 16 against an axial abutment section 52 (FIG. 5) of the tool spindle 36 or against a tool abutment flange fitted on the tool spindle.

The angular gear arrangement 22 as described in the present invention is configured in detail in the following paragraphs.

The crown gear 34 is formed in the shape of a hat (FIGS. 4 and 5). It comprises a recess 54 (FIG. 5) which is open toward the tool side, and is bordered by an elevation 56 (FIG. 4) which is formed toward the other side of the crown wheel 34. This elevation 56 has a dome shape and can also have, for example, a cylindrical or conical basic shape as viewed 24 from the outside, although this is not absolutely necessary. Positioned radially outside this elevation 56, the crown wheel 34 has a brim-like region 58 of the overall hat shape, and wherein the brim-like region 58 carries a toothing 60 of the crown wheel 34 which is located radially outside the elevation 56, and on that side of the crown wheel 34 that is remote from the tool.

Thus, as can be seen from the drawings and as was mentioned, above, the crown wheel 34 is oriented such that its recess 54 FIG. 5) is open towards the side that faces the tool, and such that its toothing 60 is formed on that side of the crown wheel 34 that is remote from the tool. In this arrangement, the pinion shaft 30, and the pinion wheel 32 are provided at least partially within the axial installation space of the crown wheel 34, and above the height of its toothing 60, thereby reducing the overall axial height of the resulting angle grinder. It further proves to be advantageous for a bearing device 62 (FIG. 4) in the form of a roller bearing to be accommodated or otherwise received within the recess 54. The bearing device 62 is held within a concentric portion 64 of the flange 44 on the side thereof that is remote from the tool. This concentric portion 64 likewise projects axially into the recess 54 (FIG. 5) of the crown wheel 34 and in the process holds the bearing device 62, and which takes the form of an outer shell of a ball bearing. The bearing device 62 is secured axially against falling out by an axially acting securing element 66 in the form of a snap ring 68, which can be clipped into an inner circumferential groove 70 in the wall of the concentric portion 64.

As mentioned, the tool spindle 36 extends through the central shaft opening 38 (FIG. 4) in the crown wheel 34 and projects axially beyond an outer side 74 of the elevation 56 by way of an end section 72 that is remote from the tool. As seen in FIG. 4, there is a second bearing device 76, which mounts the tool spindle 36 against the transmission housing 14. This bearing device 76 is closed, or covered, from above, by a bearing cover 78 (FIG. 3).

The components which are illustrated in FIGS. 4 and 5 of the drive train are advantageously configured as a premountable subassembly. More specifically, this can be mounted by way of the flange 44 on the underside of the transmission housing 14 and by means of screw connections. As a result of this arrangement, the transmission housing 14 is also substantially closed off, in a dustproof manner, from the outside. The bearing devices 62 and 76 in this case also provide a sealing function from exterior contamination or debris.

The extremely flat or low profile construction of the transmission housing 14 and of the angle grinder 4, overall, can be seen from the figures. A dimension H from a lower side, that faces the tool, of the transmission housing 14, or the flange thereof 44, to a top side of the transmission housing 6 in the entire region above the tool 16 is advantageously only about 36 mm; at the point of the longitudinal axis 40 of the tool spindle 36 it is only about 34.5 mm. However, this dimension may vary and can lie in a range of about 32 mm. to about 40 mm.

Further, a tangent 82 is formed relative to the transmission housing 14, (FIG. 3) in a longitudinal center plane of the angle grinder, said tangent at the same time touching a peripheral edge 84 of the tool 16, forms an angle of typically only about 35° with respect to the tool plane 86 in the exemplary and preferably illustrated case. This tangential angle could lie in a range of about 35° to about 42° . This also considerably improves the accessibility of acute-angle regions when the angle grinder 4 according to the invention is used.

The initially mentioned protective hood 20 can be removed from the angle grinder and attached thereto again without tools, and can be locked in various rotational positions. The attachment and tool-less adjustment of the protective hood 20 is described in detail in DE 10 2008 059 249.8 by the applicant, and so reference is made thereto in this regard, and the teachings of this reference are incorporated herein.

The invention claimed is:

1. A motor-driven angle grinder comprising:

an electric motor, enclosed within a motor housing;

a transmission housing accommodating transmission components, and having a motor shaft coupled to the electric motor, and a tool spindle which are oriented at an angle to one another via an angular gear arrangement;

a grinding or separating tool which can be driven in rotation, and which is mounted on the tool spindle;

a crown wheel forming a portion of the angular gear arrangement is formed in the shape of a hat, and further defines a recess, and wherein the recess is oriented toward a side of the crown wheel that faces the grinding or separating tool, and wherein the crown wheel further defines toothing which is arranged in a location which is radially outside an elevation which defines, at least in part, the recess of the crown wheel, and which is further located on a side of the crown wheel that is remote from the grinding or separating tool, and wherein the recess is dimensioned so as to receive the tool spindle, and a bearing which engages the tool spindle; and a flange forming a portion of the transmission housing and which has a concentric portion which extends in an axial direction and into the recess which is defined by the crown wheel, and wherein the tool spindle is mounted relative to the flange by the bearing and wherein the bearing is secured axially against falling out of engagement relative to the concentric portion of the flange by an axially acting securing element which takes the form of a snap ring which engages the flange.

2. An angle grinder as claimed in claim 1, and wherein a height (H) of the transmission housing in a region adjacent to the grinding or separating tool lies in a range of about 32 to about 40 mm, said height (H) being measured in an axial direction relative to the tool spindle from an outer side of the transmission housing that faces the grinding or separating tool, and as far as a top side of the transmission housing and which is remote from the grinding or separating tool.

3. An angle grinder as claimed in claim 2, and wherein the transmission housing has a front, and sides, and wherein the grinding or separating tool has a peripheral edge, and wherein the front of the transmission housing is beveled and extends along a course toward the sides thereof, such that the extended course of the bevel does not project beyond the peripheral edge of the grinding or separating tool.

4. An angle grinder as claimed in claim 3, and wherein a tangent is formed relative to the transmission housing and which forms an angle with a plane which is defined by the grinding or separating tool at the peripheral edge of the grinding or separating tool, and which lies in a range of about 35 degrees and about 42 degrees.

5. An angle grinder as claimed in claim 4, and wherein the tool spindle has a longitudinal axis, and further extends through the crown wheel and a second bearing for supporting the tool spindle is provided on a side of the crown wheel which is remote relative to the grinding or separating tool.

6. An angle grinder as claimed in claim 5, and wherein the transmission housing is formed in an elongate manner such that a dimension of the transmission housing measured from the longitudinal axis of the tool spindle, and extending in the direction of the motor housing is greater than a radius of the grinding and separating tool, and wherein the grinding and separating tool does not engage the motor housing.

7. An angle grinder as claimed in claim 6, and wherein the grinding and separating tool defines an upper and lower tool plane and wherein the upper and lower tool planes do not extend to a position which is beneath the motor housing.

8. An angle grinder as claimed in claim 7, and further comprising a protective hood for the grinding and separating tool and wherein the protective hood does not engage and extend below the motor housing.

* * * * *